United States Patent [19]

Rhoads et al.

[11] Patent Number: 4,778,416

[45] Date of Patent: Oct. 18, 1988

[54] MAN-POWERED HYDRAULIC STEERING SYSTEM

[76] Inventors: Buddy K. Rhoads, 5804 Lucy La., Pasadena, Tex. 77505; Billy W. Oliver, P.O. Box 3, Troy, Tex. 76579

[21] Appl. No.: 904,161

[22] Filed: Sep. 5, 1986

[51] Int. Cl.[4] ..... B63H 5/12; B63H 25/22

[52] U.S. Cl. ..... 440/61; 114/150

[58] Field of Search ..... 114/150; 440/61

[56] References Cited

U.S. PATENT DOCUMENTS

| | | | |
|---|---|---|---|
| 1,806,136 | 5/1931 | Weiss | 114/150 X |
| 2,855,755 | 10/1958 | Auger | 114/150 |
| 3,171,380 | 3/1965 | Kuhn | 114/150 |
| 3,302,604 | 2/1967 | Stuteville | 114/150 |
| 3,587,513 | 6/1971 | Stimatze | 440/61 |

*Primary Examiner*—Sherman D. Basinger

[57] ABSTRACT

This invention is a method of steering a boat by rotation of the outboard motor (or lower unit in the case of an inboard/outdrive unit) about its pivot point by hydraulic principles. This invention is comprised of a driven cylinder mounted near the motor (lower unit), the hydraulic pump, which is another cylinder, and the motor, which is simply a man-powered steering wheel, and flexible lines to carry the hydraulic fluid between the pump and the driven cylinder.

1 Claim, 1 Drawing Sheet

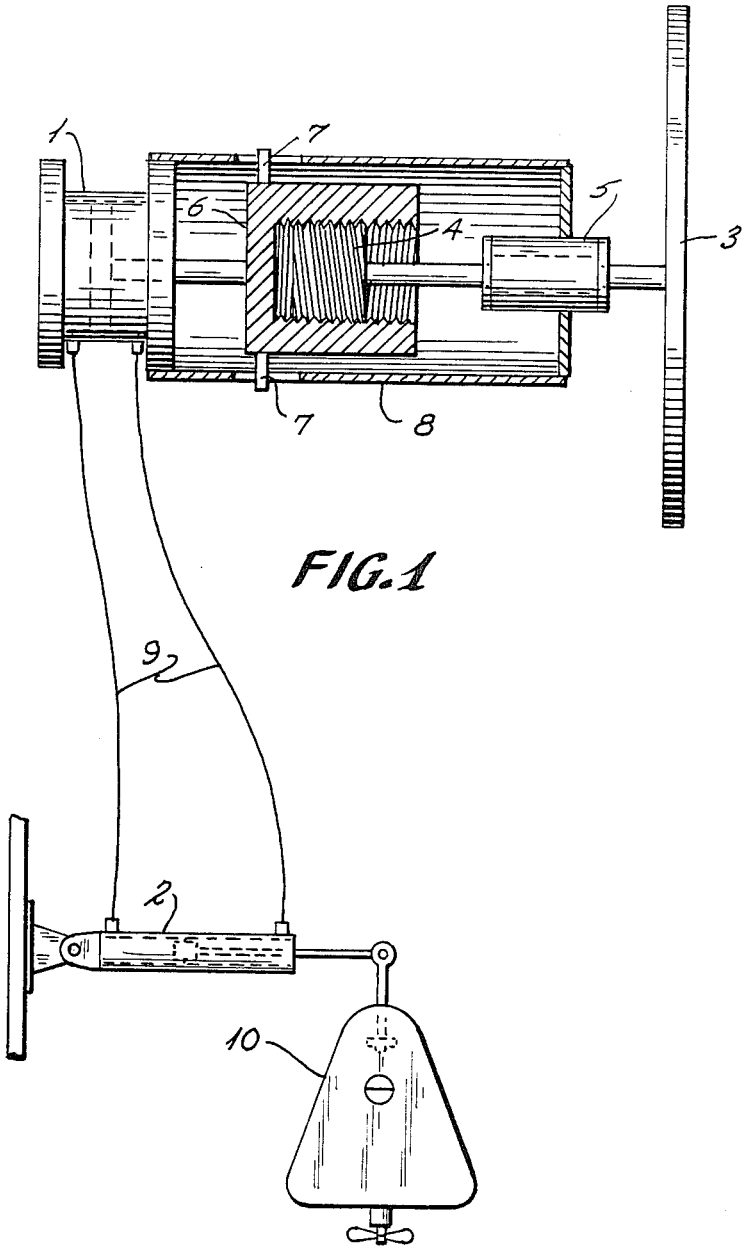
FIG. 1
FIG. 2
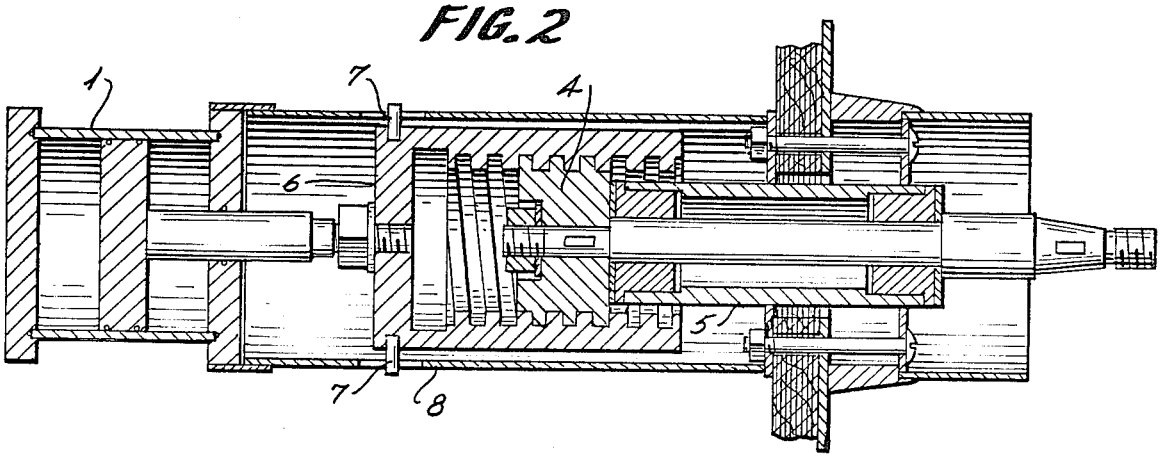

MAN-POWERED HYDRAULIC STEERING SYSTEM

BACKGROUND OF INVENTION

This invention, in general, relates to steering systems as applied to small pleasure boats, particularly to outboard engines and inboard/outdrive units.

The majority of small boats use some form of cable steering system. Boats with engines of around 25 horsepower use a continuous small diameter cable. Each end of the cable is affixed to the two sides of the engine, the center of the cable being wrapped around a steering wheel capstan. There are two major problems with this system, the least severe problem being the slippage between cable and capstan. The biggest problem is one of corrosion and subsequent breakage of constantly weather exposed cables.

Larger horsepower engines of up to 125 HP use a cable system known as the "Morse" system. This system uses a much heavier cable enclosed in a flexible housing. The housing reduces corrosion and the heavier cable almost eliminates breakage, but the problem now becomes one of routing the stiffer cable within the narrow confines of the boat. The single cable and its housing have to make some very sharp bends for a cable of this size, resulting in increased wear at these points. As stated previously, this housing reduces corrosion but does not eliminate it. This corrosion and wear of the friction reducing lining continue until the cabe refuses to slide in its housing. The only cure now will be an expensive replacement of the cable.

An additional problem of the single cable system is that the cable has to push the engine about its steering axis, as well as pull. Bending of the cable in its push mode has not been a problem with the torque of engines below 125 HP. Larger engines have created bending of the cables. The boat industries solution to date has been to add an additional cable to the same side of the engine. The two cables still must push the motor, a job that a cable is not very well suited for. These cables are very expensive and we now have a double expense without doing anything for corrosion and rapid wear.

A hydraulic system would result in a positive means of steering the boat and corrosion would be drastically reduced. Flexible hydraulic lines could be routed wherever the boat manufacturer desired without having to consider any binding problems. The system could be similar to that used in the automobile industry where an inboard engine was utilized, and would even be possible with an outboard engine, but either system would be needlessly expensive in the small pleasure boats.

A much simpler system would consist of one hydraulic cylinder driving another hydraulic cylinder.

SUMMARY

The simplest method of obtaining this hydraulic system would be to have both master cylinder and slave cylinder identical to each other with a mechanical advantage derived from a rack and pinion or similar arrangement. At the motor there is ample room to mount a cylinder of the necessary stroke length, but to mount an identical cylinder under the steering console would be near impossible because of space limitations. The solution is to have a shorter stroke cylinder of greater bore size, and drive it with a screw arrangement connected directly to the end of the steering wheel shaft.

In the prototype, it was determined that a slave cylinder with a stroke of 8" was required for full rotation of the motor. A bore size of $1\frac{1}{2}''\phi$ with shaft measuring $\frac{1}{2}''\phi$ was chosen because of availability. To arrive at the master cylinder bore, it was decided that a stroke of 2" would fit in the space available without resulting in too great of a bore size. By calculating the volume of the slave cylinder when fully extended and using this volume to determine the bore for the master cylinder, it will be found that a $3''\phi$ bore/2" stroke cylinder would be compatible with the $1\frac{1}{2}''\phi$ bore/8" stroke slave cylinder.

Shaft sizes of the two cylinders must also have compatible volumes. By calculation it sill be found that a $1''\phi$–2" stroke master cylinder shaft will be compatible with a $\frac{1}{2}''\phi$–8" stroke slave cylinder shaft.

It was decided that 4 revolutions of the steering wheel should give sufficient mechanical advantage and still not be overly sensative when steering wheel is inadvertantly turned a small amount. To obtain the 2" stroke of the master cylinder with 4 revolutions of the steering wheel requires two threads per inch on the screw mechanism coupling the steering shaft to the master cylinder. (4 revolutions$\times$1 inch/2 revol.=2" travel) Data from a machinists handbook shows that the minimun diameter recommended for two threads per inch is $2\frac{1}{4}''$, so that a minimum helix angle will be held. The prototype female screw was sized so that it would work over the steering shaft housing, resulting in the most compact length of the master cylinder components. This resulting diameter is greater than $2\frac{1}{4}''$, therefore, the helix angle is smaller than the recommended angle, a desirable feature.

Calculation of peak line pressure was derived from the formula:

$$Q = \frac{F}{\dfrac{P + 2\pi\mu r}{2\pi r - \mu p} \times \dfrac{r}{R}}$$

where

Q=load in pounds exerted by screw

F=force in pounds exerted on moment arm ($15''\phi$ steering wheel)

P=lead of thread in inches ($\frac{1}{2}''$)

r=pitch radius of screw in inches (1-5/16")

$\mu$=coefficient of friction (0.23")

R=length of moment arm in inches ($7\frac{1}{2}''$)

"F" was assumed to be approximately 75 lbs., the force a normal man would likely to exert if the motor was held in a locked position.

"Q" will work out to approximately 1500 pounds.

$$\frac{1500 \text{ pounds}}{7.07 \text{ sq. in.}^*} = 212.2 \text{ pounds/sq. in.}$$

*(area of master cylinder piston)

Any reasonably good hydraulic line will withstand 212 PSI, therefore no other consideration will be given to the problem of line pressure.

DRAWINGS

FIG. 1 is a diagram of system operation.

FIG. 2 is a cross section thru centerline of master cylinder and its component parts.

DESCRIPTION OF PREFERRED EMBODIMENT

Movement of the master cylinder 1 piston will force hydraulic fluid from it, thru the connecting lines 9 and into the slave cylinder 2 forcing its piston to move, producing rotation of the motor or lower unit 10 .

These cylinders 1 2 have been sized so that a small movement of the master cylinder 1 piston results in a proportionately large movement of the slave cylinder 2 piston. Movement of the master cylinder 1 piston is initiated by a screw mechanism 4 6 affixed respectively to the steering wheel 3 and the shaft of the master cylinder 1 . Rotation of the steering wheel 3 results in the elongation or shortening of the screw assembly 4 6 . Lateral movement of the male screw 4 is restrained by the steering shaft thrust bearing assembly 5 . Rotational movement of the female screw 6 , due to friction, is prevented by two hardened steel pins 7 riding in slots cut into the sides of the component housing 8 . The only movement now possible is the lateral movement of the female screw 6 resulting in the desired movement of the master cylinder 1 piston.

We claim:

1. An hydraulic steering system for a boat comprising:

a component housing having an outer surface, said component housing having mounted thereon at a first end a steering wheel and thereon at a second end a master cylinder, a piston located within said master cylinder, a piston rod fixed to said piston and extending into said housing, a screw assembly located within said housing and comprising a male and a female screw, said female screw having mounted thereon a plurality of pins, a plurality of slots extending through said housing outer surface, said pins extending through said slots so as to prevent rotation of said female screw while allowing movement of said female screw along a longitudinal axis of said housing, said steering wheel being coupled to said male screw, and said piston rod being fixed to said female screw;

a slave cylinder, said slave cylinder having a piston therein, a piston rod fixed to said slave cylinder piston, said slave cylinder piston rod coupled to a propulsion unit for said boat, hydraulic lines connecting said master cylinder and said slave cylinder, hydraulic fluid contained within said master cylinder, said slave cylinder, and said lines;

whereby, turning said steering wheel turns said male screw within said female screw so as to move said female screw along said longitudinal axis and within said housing thereby moving said master cylinder piston, movement of said master cylinder piston through said hydraulic fluid and said connecting lines moving said slave cylinder piston and said slave cylinder piston rod so as to steer said propulsion unit.

* * * * *